US009675833B2

(12) United States Patent
Solow et al.

(10) Patent No.: US 9,675,833 B2
(45) Date of Patent: Jun. 13, 2017

(54) EXERCISE TABLE

(71) Applicants: Howard J. Solow, Boulder, CO (US); Christopher J. Hahn, Longmont, CO (US)

(72) Inventors: Howard J. Solow, Boulder, CO (US); Christopher J. Hahn, Longmont, CO (US)

(73) Assignee: Mad Dogg Athletics, Inc., Venice, CA (US)

( * ) Notice: Subject to any disclaimer, the term of this patent is extended or adjusted under 35 U.S.C. 154(b) by 0 days.

(21) Appl. No.: 14/829,568

(22) Filed: Aug. 18, 2015

(65) Prior Publication Data

US 2016/0206911 A1 Jul. 21, 2016

Related U.S. Application Data

(63) Continuation of application No. 13/421,185, filed on Mar. 15, 2012, now Pat. No. 9,108,079.

(60) Provisional application No. 61/465,229, filed on Mar. 16, 2011.

(51) Int. Cl.

| | |
|---|---|
| ***A63B 26/00*** | (2006.01) |
| ***A63B 21/00*** | (2006.01) |
| ***A63B 21/055*** | (2006.01) |
| ***A63B 23/02*** | (2006.01) |
| ***A63B 21/02*** | (2006.01) |
| ***A63B 23/035*** | (2006.01) |
| ***A63B 23/04*** | (2006.01) |
| ***A63B 21/04*** | (2006.01) |
| ***A63B 22/00*** | (2006.01) |

(52) U.S. Cl.

CPC .. *A63B 21/00065* (2013.01); *A63B 21/00069* (2013.01); *A63B 21/023* (2013.01); *A63B 21/0428* (2013.01); *A63B 21/055* (2013.01); *A63B 22/0089* (2013.01); *A63B 23/02* (2013.01); *A63B 23/03525* (2013.01); *A63B 23/0405* (2013.01); *A63B 2208/0252* (2013.01)

(58) Field of Classification Search

USPC ..... 482/1–148

See application file for complete search history.

(56) References Cited

U.S. PATENT DOCUMENTS

| | | | | |
|---|---|---|---|---|
| 6,120,425 A * | 9/2000 | Endelman | ..... | A63B 21/023 482/132 |
| 6,186,929 B1 * | 2/2001 | Endelman | ..... | A63B 21/023 482/101 |
| 6,371,895 B1 * | 4/2002 | Endelman | ..... | A63B 21/023 482/101 |
| 6,685,606 B2 * | 2/2004 | Endelman | ..... | A63B 21/023 482/121 |

(Continued)

*Primary Examiner* — Stephen Crow

(74) *Attorney, Agent, or Firm* — Maceiko IP

(57) ABSTRACT

An improved exercise table or reformer having increased adjustability and storage features. The starting point of the carriage or platform is adjustable to accommodate different sized users. An anchor bar mechanism is adjusted to correspond to carriage starting point, and limits rotation of the anchor bar with respect to the reformer and may be non-removable from the reformer frame. A foot bar assembly may be adjusted and placed in a storage position, allowing the foot bar to serve as a lift handle. The reformer's adjustability provides greater ease of storage.

20 Claims, 11 Drawing Sheets

(56) References Cited

U.S. PATENT DOCUMENTS 6,926,650 B2 * 8/2005 Endelman ..... A63B 21/023 482/121
7,125,368 B2 * 10/2006 Endelman ..... A63B 21/16 482/121
7,125,369 B2 * 10/2006 Endelman ..... A63B 21/154 482/121
7,163,500 B2 * 1/2007 Endelman ..... A63B 21/04 482/139
7,288,054 B2 * 10/2007 Endelman ..... A63B 23/03525 482/121
7,674,211 B2 * 3/2010 Uygan ..... A63B 21/154 482/123
7,857,736 B2 * 12/2010 Merrithew ..... A63B 21/00 482/121
8,152,705 B2 * 4/2012 Rooks ..... A63B 21/022 482/122
8,157,714 B2 * 4/2012 Mayr ..... A63B 22/0087 482/121
8,394,005 B2 * 3/2013 Solow ..... A63B 21/023 482/121
8,435,163 B2 * 5/2013 Uygan ..... A63B 21/154 482/102
8,602,953 B2 * 12/2013 Jordan ..... A63B 21/055 482/121
8,721,511 B2 * 5/2014 Endelman ..... A63B 21/156 482/121
9,022,909 B2 * 5/2015 Kermath ..... A63B 21/00018 482/133
9,108,079 B2 * 8/2015 Solow ..... A63B 21/055
9,199,123 B2 * 12/2015 Solow ..... A63B 26/00
2012/0283079 A1 * 11/2012 Solow ..... A63B 21/0552 482/142
2014/0121079 A1 * 5/2014 Lagree ..... A63B 71/0622 482/139
2014/0141948 A1 * 5/2014 Aronson ..... A63B 21/023 482/128
2014/0309087 A1 * 10/2014 Uygan ..... A63B 21/062 482/93
2015/0119213 A1 * 4/2015 Savarino ..... A63B 21/02 482/142

* cited by examiner

EXERCISE TABLE

CROSS REFERENCE TO RELATED APPLICATION

This application is a continuation of U.S. application Ser. No. 13/421,185, filed on Mar. 15, 2012, which claimed priority to U.S. Provisional Application Ser. No. 61/465,229, filed Mar. 16, 2011. The foregoing applications are incorporated by reference as if fully set forth herein.

FIELD OF THE INVENTION

The current invention generally relates to exercise equipment, including an improved exercise table or "reformer" with improved adjustability and/or storage capability to be used in pilates type exercises.

BACKGROUND OF THE INVENTION

Exercise and other efforts to improve physical fitness and general health have become increasing popular. Many different forms of exercise and fitness routines have come into being such as aerobics, weight training, yoga and more recently, exercises related to pilates, gyrotonics and the like. Pilates has become increasingly popular since it provides a unique blend of training to improve flexibility, strength and aerobic stamina.

Various forms of exercise may be performed without the use of any equipment, while other forms may require basic or specialized equipment. Many exercises associated with pilates involve an exercise table that is commonly referred to as a reformer. A reformer typically includes a frame which supports a platform or carriage that may move back and forth along the frame's length. A user may lie, kneel or assume some other body position on the platform. Springs are typically connected to the platform and extend to the frame where one or more of the springs are typically attached to adjust the resistance to be experienced by the user. The user may press against the frame with his or her hands or feet, and thereby move the platform away from the end of the frame against the spring's resistance. The bias of the springs will then tend to move the carriage so that it returns to its original position, and the user may exert resistance to control this return motion. The carriage thus moves back and forth along the length of the frame.

Typical reformers include a foot bar which extends upward from the foot end of the frame and against which the user may apply pressure to move the platform away from the foot end against the spring's resistance. Typical reformers also include handles attached to ropes which the user may also pull to move the platform against the spring's resistance.

Many pilates studios have one or more reformers that are used by different people. Sometimes, a given reformer will be used by numerous people in a given day. The height and body proportions, such as leg and torso lengths, may vary between users, sometimes significantly.

Accordingly, there exists a need to adjust the start position of the spring resisted platform or carriage relative to the foot bar so that users of all heights and leg lengths may exercise in an appropriate and safe range of motion. For example, if a user with long legs were forced to lie down on the carriage in the same starting position as a user with short legs, the legs of the taller user may be unsafely cramped at the starting position.

When the start position of the carriage is changed, that typically also changes the starting resistance of the springs connecting the platform to the frame. For example, where the carriage starts at a position near the foot end of the frame, the springs may hang loosely and provide no resistance. Alternatively, if the carriage starts at a position further away from the foot end of the frame, the springs may already be taut and therefore provide resistance.

Accordingly, there is also a need for a means to adjust the start position of the resistance springs, preferably commensurate with the start position of the carriage. In this manner, users of various heights and with different leg lengths may experience the same or similar start tension and resulting force curves for whatever combination of spring(s) are attached to the frame as the springs are extended through movement of the carriage.

In prior reformers, all the springs are typically attached at one of their ends to the platform underside. One or more of the other ends of the springs are typically attached to a bar that is in turn removably attached to the frame. Sometimes, this bar is referred to as an anchor bar. To adjust the start position of whatever spring(s) are attached to the anchor bar (and thus to the frame), the anchor bar is typically moved between several mounting or functional locations on the frame, such as slots. Several types of mechanisms have been used to adjust the spring anchor bar on pilates equipment, but they typically face several drawbacks.

As an example, certain adjustable anchor bars may be generally cumbersome to adjust between functional locations on the frame because they need to be pulled out of angled slots or the like. This may be cumbersome and result in less than optimum performance where quick adjustment of the anchor bar functional location is desired.

As another example, certain adjustable anchor bars must be completely removed from the reformer when adjusting their functional location. As such, they are loose parts which may be lost, leading to inconvenience and extra expense. Accordingly, there is a need for an improved adjustable anchor bar mechanism which addresses the foregoing issues associated with adjusting its functional location.

As noted above, one or more the springs are typically attached to the anchor bar (and thus to the frame) to vary the resistance experienced by the user. Many adjustable anchor bars are simply round rods that have a number of eyebolts attached thereto. The spring(s) are selectively attached to the eyebolts to vary the resistance to be experienced by the user. However, because these anchor rods are round, they may rotate within the functional slot locations. And oftentimes when the number of springs attached to the anchor bar is adjusted, there are no spring(s) attached to the eyebolts. When this happens, the weight of the eyebolts typically causes the rod to rotate so that the eyebolts are pointing downward. Because of this, when the user or instructor wants to re-attach one or more springs to the rod, they must first rotate the rod in the other direction so that the eyebolts are pointing toward the carriage, and then re-attach the spring(s). This is a cumbersome operation and typically requires two hands, and may result in less than optimum performance where quick adjustment in the number of springs attached to the anchor bar is desired Many pilates studios are relatively small. In such studios, space may be at a premium, especially if there are a number of reformers in the studio. For example, a pilates studio may provide reformer instruction but may also provide mat or other types of instruction requiring space. Accordingly, a studio may need to move the reformers to provide space for other instruction. Also, where the reformer is intended for home use, the user may want to store the reformer after its use.

Accordingly, there exists a need to provide improved storage capability of reformers. Where reformers may be stored by stacking them on top of each other, there exists a need for an improved manner to pick up the reformer to place it on top of another, as well as the manner in which stacked reformers engage each other. Where reformers may be vertically stored, there exists a need for an improved manner to tilt the reformer from its horizontal functional position to a vertical storage position, as well as improvement in the stability of the reformer once it is in a vertical position.

SUMMARY OF THE INVENTION

The exercise table, or reformer, of the current invention addresses the foregoing and other issues.

In one aspect of the current invention, an adjustable foot bar assembly that includes a storage position is described.

In another aspect of the current invention, an adjustable foot bar may be securely positioned in a storage position. The adjustable foot bar may also be used as a lift handle to help pick up the reformer for stackable storage.

In another aspect of the current invention, an adjustable anchor bar assembly that may be quickly adjusted from one mounting location to another is described. The anchor bar assembly preferably remains attached to the reformer so as to avoid getting lost.

In another aspect of the current invention the rotation of the anchor bar assembly is prevented or limited when there are no springs attached thereto.

In another aspect of the current invention, a mechanism to adjust the starting position of the platform or carriage is described.

In another aspect of the current invention, the adjustability of the foregoing in combination is described. That is, the starting position of the carriage and the starting position of spring resistance may be adjusted in connection with each other or separately.

In another aspect of the invention, storage of multiple reformers is described, including nestable stacking and vertical storage, as well as improvements in the manner in which reformers are so stored.

Other aspects, features and details of the present invention can be more completely understood by reference to the following detailed description of the preferred embodiment taken in conjunction with the drawings and appended claims.

DETAILED DESCRIPTION OF THE PREFERRED EMBODIMENTS

Figure 1:
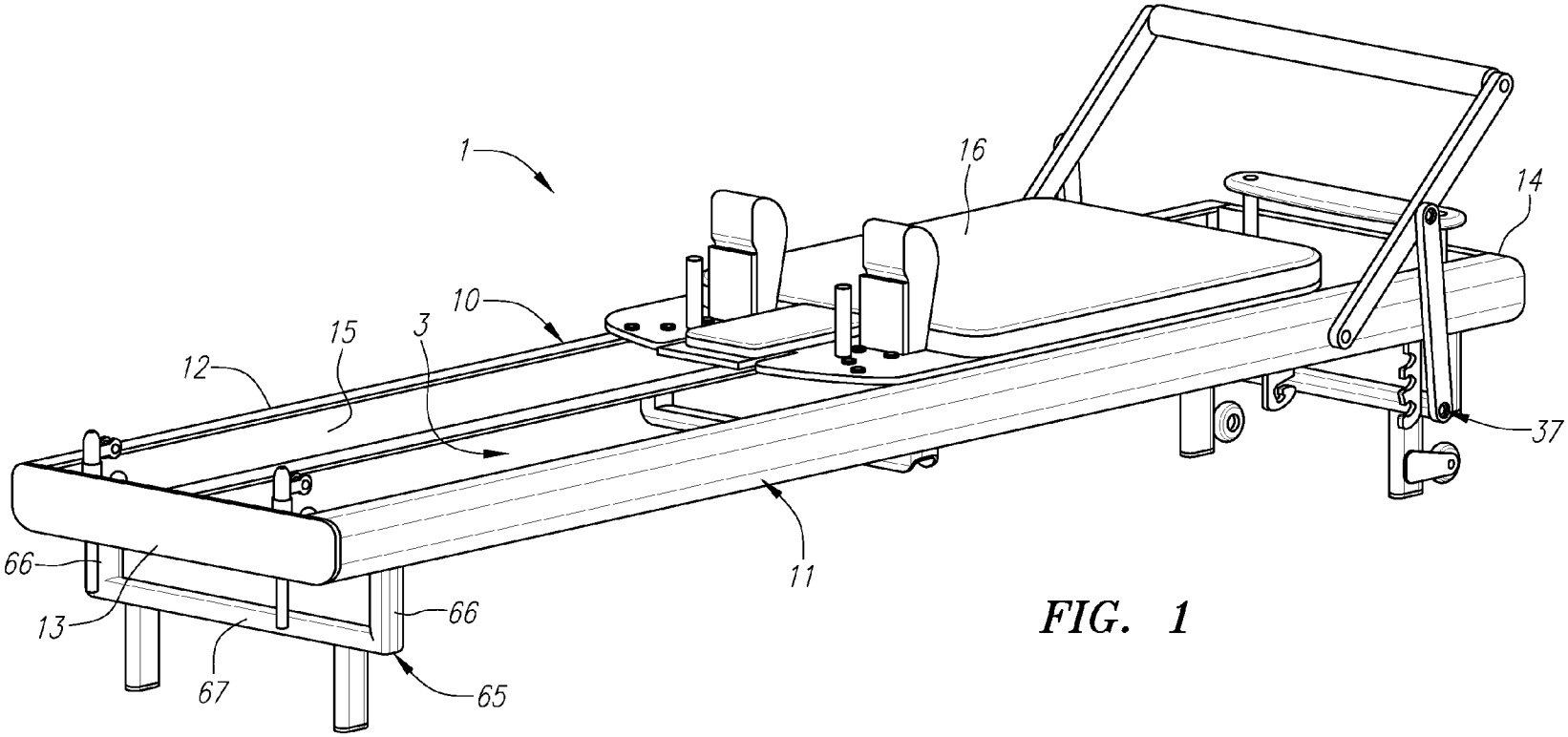
FIG. 1 is a perspective view of an exercise table.

Embodiments of the current invention will now be described with reference to the drawings. To facilitate the description, any reference numeral representing an element in one figure will represent the same element in any other figure. The current invention is not limited to the specific description below, as one skilled in the art will appreciate that variations may occur to the subject matter described below while still being within the scope and content of the current invention. The description below makes reference to reformers, but one skilled in the art will recognize that the current invention is suitable for use with other types of exercise equipment, such as equipment wherein the starting point of spring resistance is desired to be moved.

Referring to FIG. 1, an exercise table or reformer 1 typically used for certain pilates exercises is shown. Table 1 includes frame 10 that may be rectangular and extend about the periphery of table 1, thereby defining an open interior 3. Frame 10 may include side members, a head member and a foot member. More particularly, frame 10 may include a longitudinally extending right side member 11, a longitudinally extending left side member 12, a head member 13 and a foot member 14. The frame members 11, 12, 13, 14 may be attached together by any appropriate means.

Figure 2:
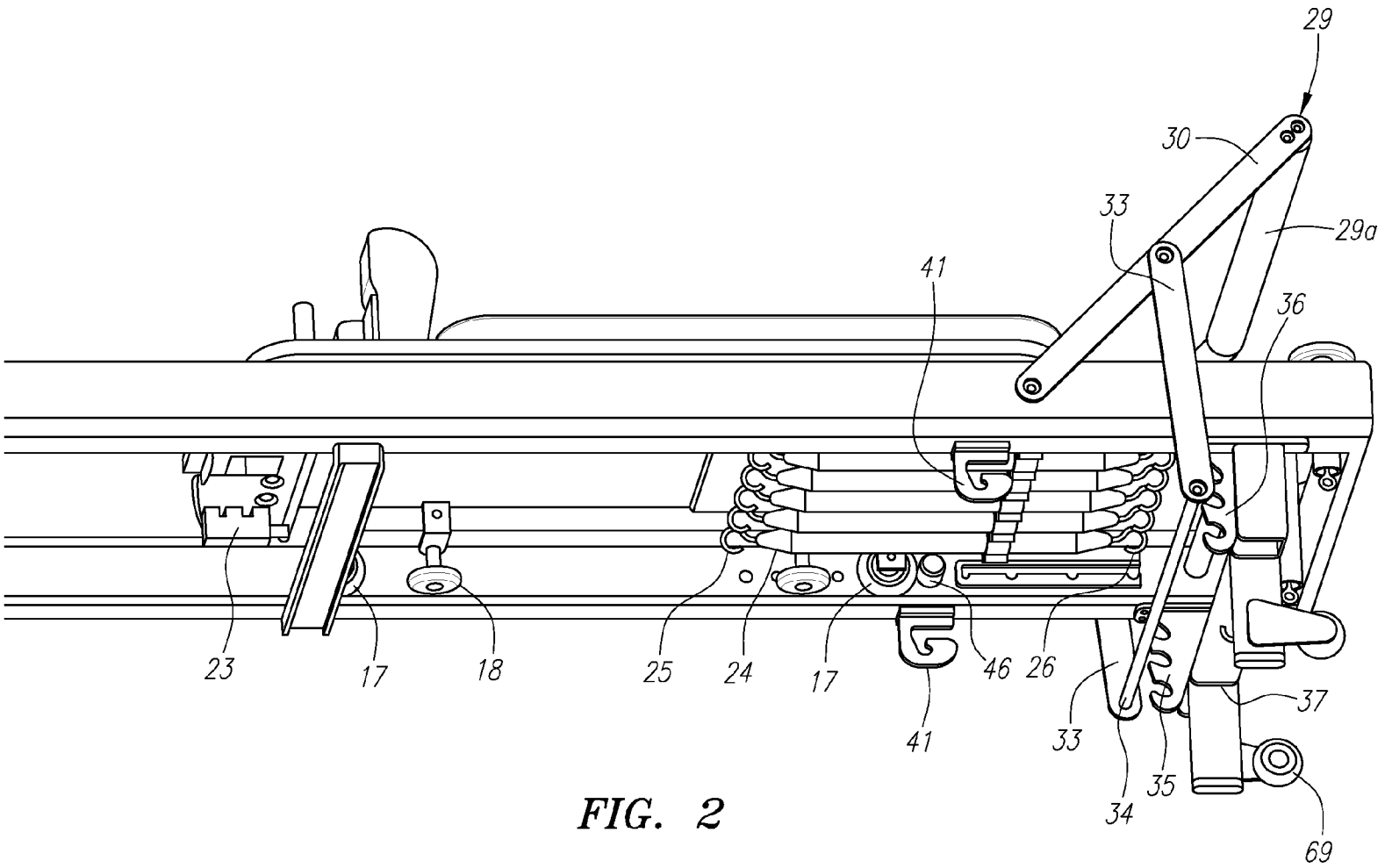
FIG. 2 is an underneath perspective view of an exercise table.

Exercise table or reformer 1 also includes a platform 16 on which the user lies or assumes some other body position, and which may longitudinally move back and forth along the sides of frame 10. To this end, side frame members 11, 12 may include inwardly opening channels 15 as shown in FIGS. 1 and 2, which may define tracks in which vertical rollers may move. Channels 15 may comprise inward facing u-shaped flanges that include a bottom horizontal flange, a vertical wall attached to the side member 11 or 12, and an upper horizontal flange. In a preferred embodiment a channel 15 may be contiguous with a side member 11 or 12 such that they comprise a single piece. In other embodiments, channel 15 may be separate from side member 11 or 12 but may be attached thereto by suitable fastening means.

Vertical rollers 17 may engage the bottom horizontal flange and slide in the channel 15. Vertical rollers 17 may be attached to platform 16 by a bracket or other suitable device, and may support platform 16 at it moves along the length of frame 10 as shown in FIG. 2. As also shown in FIG. 2, horizontal rollers 18 contact the vertical wall of the inward channel 15 and may also be attached to and support platform 16. Horizontal rollers preferably help ensure that platform 16 moves in a straight line as it longitudinally articulates back and forth along frame 10.

Platform 16 is now more specifically described with reference to FIG. 3. Platform 16 preferably includes a rigid structural panel 19 of generally rectangular configuration. Platform 16 is preferably designed to support the weight of the user and is sized to accommodate the trunks of larger users. Platform 16 preferably includes support cushion 20 to provide comfort to the user when he or she lies or kneels on it, or assumes some other body position thereon. Cushion 20 may be attached to panel 19 in any suitable manner.

Platform 16 and panel 19 may include a head end and foot end that correspond to the head end 13 and foot end 14 of frame 10. At the head end of the panel 19, an adjustable height head support 21 may be centrally positioned for supporting a user's head. Head support 21 may be arranged flat (as shown) or tilted up to place the user's neck in predetermined angles. A pair of shoulder blocks 22 may be located on either side of head support 21. Blocks 22 may support the shoulders or other body parts such as feet, hands or knees of the user depending upon the exercise being performed.

Figure 3:
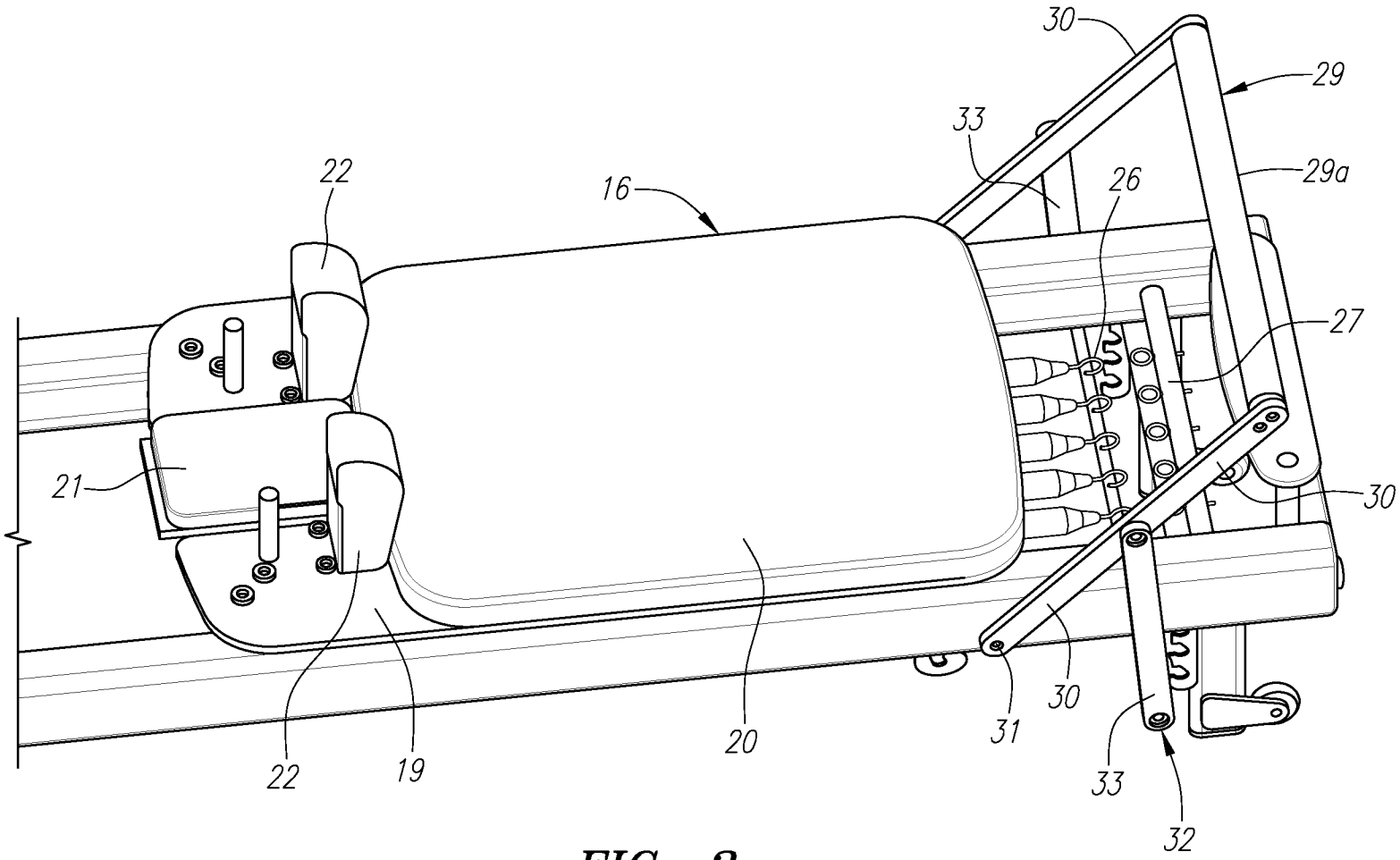
FIG. 3 is a top perspective view of an exercise table.

Referring to FIGS. 2-3, rope locks 23 may be attached to the underside of panel 19. Rope locks 23 may be positioned on each side of shoulder blocks 23, and their purpose is described later.

Figure 8:
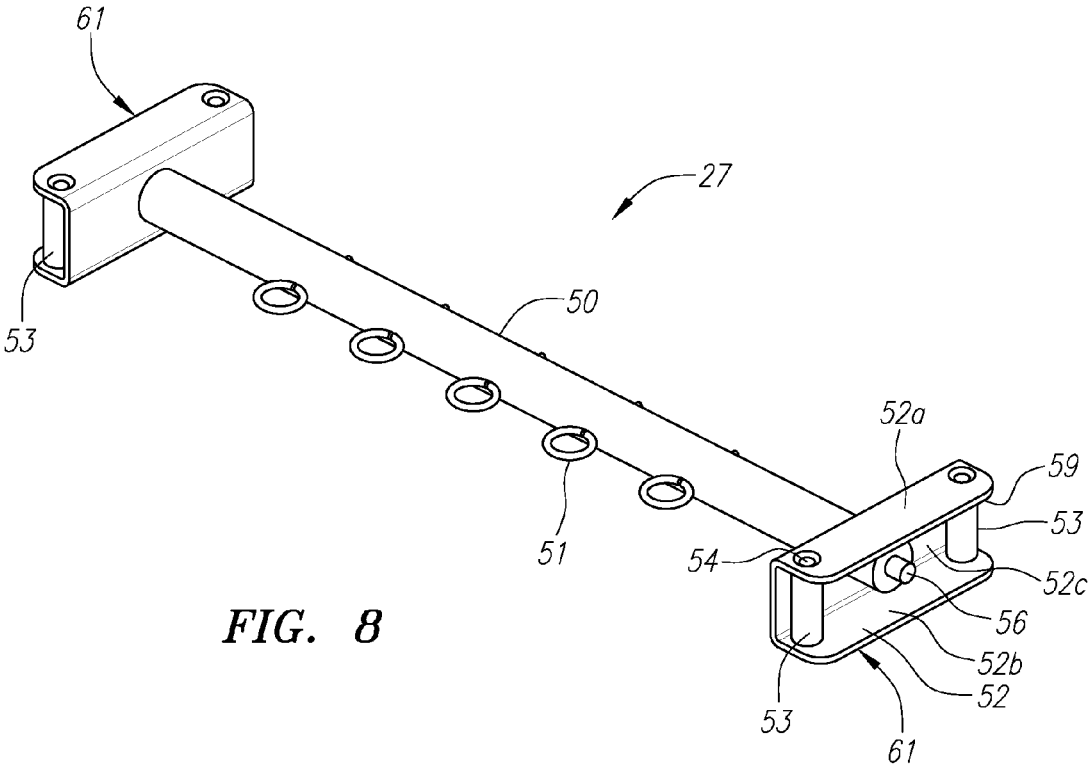
FIG. 8 is a perspective view of an anchor bar assembly.

Referring again to FIG. 2, a plurality of resistance members 24 may be attached to platform 16 at their first ends 25. The current invention also contemplates using a single resistance member 24. In one embodiment, resistance members 24 comprise coil springs that are attached to the underneath of panel 19. The second ends 26 of springs 24 may be selectively attached to anchor bar assembly 27, so that different spring resistances may be experienced by the user. In FIG. 3, second ends 26 are not shown attached to anchor bar assembly because in practice, the number of springs attached to anchor bar assembly 27 will vary according to the strength of the user and the exercise being performed. In any event, and as shown in FIG. 8, anchor bar assembly 27 may include a bar or rod 50 and a plurality of eyebolts 51 attached thereto. The second ends 26 of one or more springs 24 may be selectively attached to eyebolts 51 to suit the exercise and user. It should be noted that other suitable devices for attaching springs 24 to anchor bar assembly 27 may be used.

Anchor bar assembly 27 may include anchor bar positioning devices 61 that are attached to either end of bar 50 and that serve to couple anchor bar assembly 27 to frame 10. In a preferred embodiment, positioning devices 61 may comprise u-channels 52 that engage frame 10 at different mounting, or functional, locations as explained later. In this manner, the start position of spring tension may be adjusted. As discussed in more detail below, the anchor bar assembly 27 of the current invention preferably allows for the quick and efficient adjustment of the start position of spring tension.

While anchor bar assembly 27 may move relative to frame 10 between different functional locations, it is preferred that assembly 27 generally remain attached to frame 10. In a preferred embodiment, this occurs by virtue of the positioning devices 61 comprising u-shaped channels that surround positioning plates attached to the frame as discussed below. This is advantageous since it avoids the anchor bar 27 from becoming a loose component that may be lost or damaged. It is also preferred that the positioning devices 61 prevent or limit the amount of rotation that anchor bar assembly may undergo when no springs are attached to it. In a preferred embodiment, this occurs by virtue of the length of positioning devices 61 as they engage the positioning brackets attached to frame 10 as discussed later. This is advantageous because it simplifies changing the spring attached by the user or instructor, i.e., rod 50 will not rotate so that eyebolts 51 are facing downward. Instead, eyebolts 51 remain generally horizontal so that selection of springs may be a one-hand operation.

With the reformer configuration described above, it will be appreciated that the support platform 16 may move back and forth in the open area 3 of frame 10 by rolling along the side frame members 11, 12 from a start position proximate the foot end 14 toward the head end 13 of frame 10 against the bias of resistance elements 24, which will automatically return platform 16 toward the foot end 14 when the counter bias force (such as the user pushing his or her legs) is released or lessened.

An aspect of the current invention involving a foot bar assembly for an exercise table is now described in more detail with reference to FIGS. 2-4. Foot bar assembly 29 may be mounted to frame 10 near its foot end 14. Foot bar assembly 29 may comprise rod or bar **29*a* and side links 30 which may be mounted to each end of bar 29*a*. The lower ends of side links 30 may be mounted to frame 10, and more specifically to sides 11, 12, via pivot pins 31. Pivot pins 31 preferably rotate so that foot bar assembly 29** may be adjusted as described below.

Foot bar assembly 29 may also include support bar assembly 32, which may in turn include side bars 33 that are mounted to each end of round engagement bar or rod 34 as shown in FIGS. 2-3. Side bars 33 are preferably pivotally connected to side links 30 as shown to allow for adjustment of foot bar assembly 29.

Figure 4:
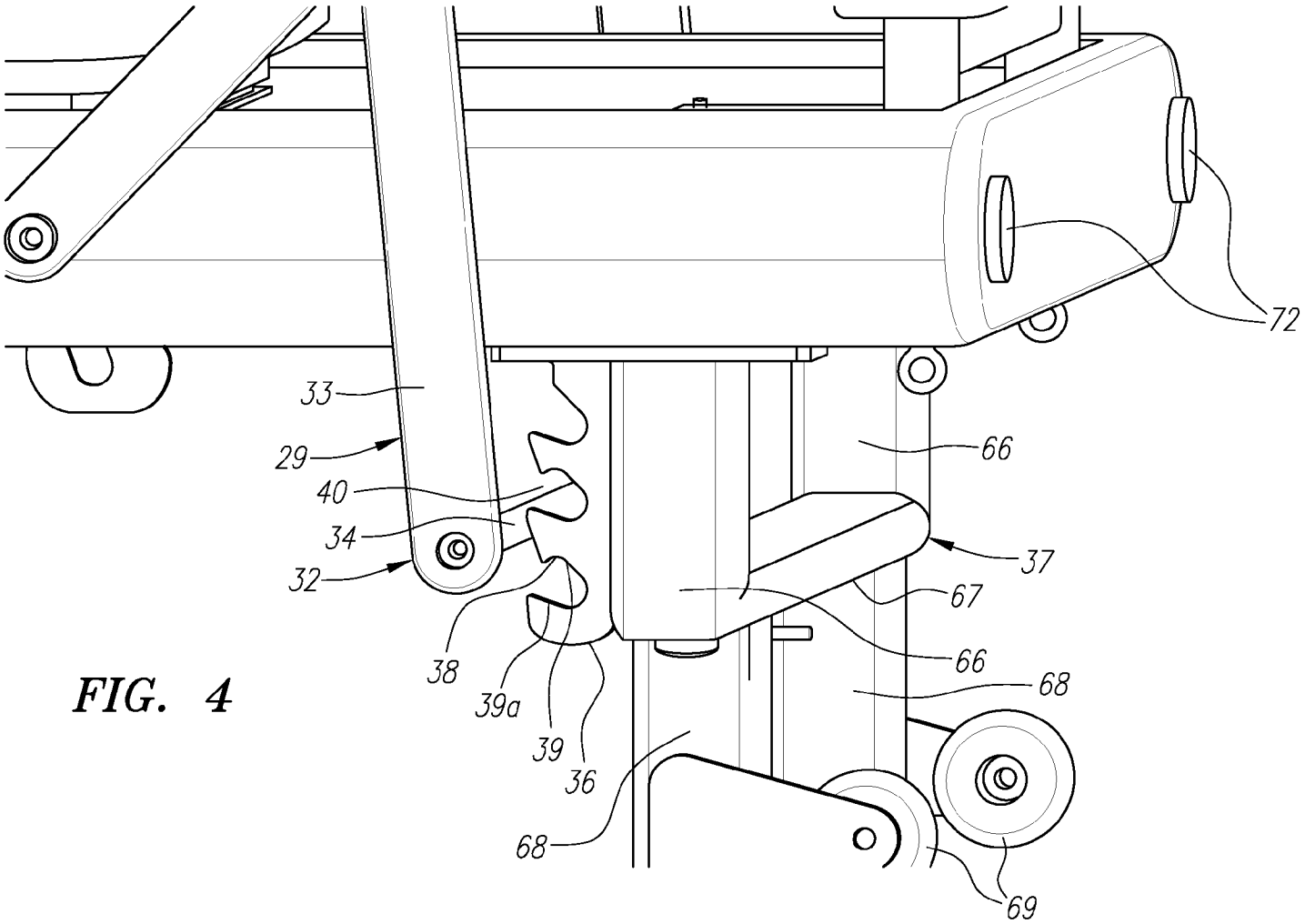
FIG. 4 is a detailed view of a foot end portion of an exercise table including an adjustable foot bar assembly.

To facilitate adjustment of foot bar assembly 29, engagement bar 34 may engage any of the slots 40 of positioning flanges 35, 36 as shown in FIGS. 2-4. The slots of each flange are preferably at the same vertical position of the corresponding slots in the other flange. Flanges 35, 36 may be mounted to foot end leg assembly 37, which may in turn include vertical legs 66 and horizontal connector leg 67 which serves to connect legs 66. The top ends of legs 66 may be mounted to the underside of frame 10. More specifically, positioning flanges 35, 36 may each be mounted to a vertical leg 66. Alternatively, flanges 35, 36 may be mounted to the underside of side frame members 11, 12.

As noted above, flanges 35, 36 each preferably provide a plurality of slots 40 in which engagement bar 34 may be located. Adjusting engagement bar 34 into any pair of positioning slots 40 serves to vary both the horizontal and vertical positions of foot bar **29*a*** to better accommodate users of different anthropomorphic measurements and for proper positioning for the execution of various exercises.

It is preferred that each positioning slot 40 includes a locking feature 38. The locking feature enhances safety by preventing engagement bar 34 from becoming dislodged from a pair of positioning slots 40 if foot bar **29*a* is accidentally pulled toward the head end 13 of reformer 1. If foot bar 29*a* is pulled toward the head end 13, the configuration of slots 40 preferably provides that engagement bar 34 will move upward until contacting the roof 39 of a respective left and right positioning slot 40. If foot bar 29*a* is pulled further toward the head end 13, engagement bar 34 is preferably restricted by locking feature 38 which prevents further movement. If the user releases the force on foot bar 29*a*, slots 40 are configured so that engagement bar 34 preferably returns the bottoms 39*a* of the respective pair of positioning slots 40**.

To release engagement bar 34 from a pair of slots 40, foot bar **29*a* is preferably first pulled slightly toward the head end 13 of reformer 1, thereby raising engagement bar 34 to a position proximate the center of the particular positioning slots 40. Support bar assembly 32 may then be moved through the mouth of the positioning slots 40 thereby withdrawing engagement bar 34** from its locked position.

Figure 15:
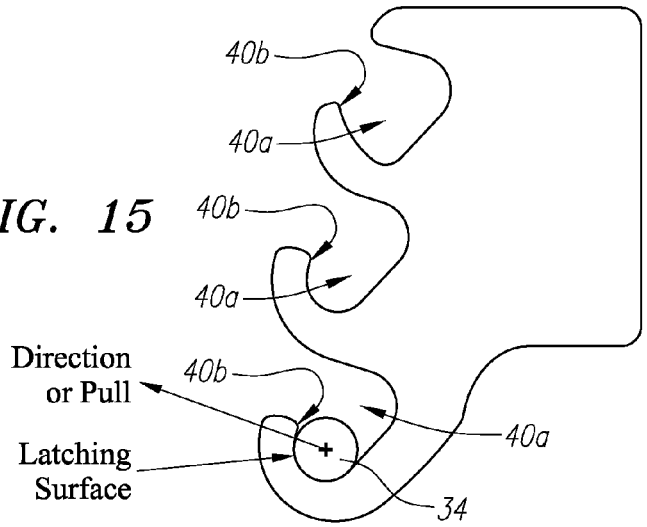
FIG. 15 is a side view of a positioning plate.

Referring to FIG. 15, an alternate embodiment for positioning plate 35, 36 is now described. In this embodiment, the shape of the engagement slots 40*a* preferably further guard against engagement bar 34 accidentally discharging therefrom. As shown, each slot 40*a* may include a latching surface that is generally located on the bottom portion of slot 40*a*. In this embodiment, engagement bar 34 is more secured by this latching surface 40*b*, as opposed to a feature on the top of slot 40*a* like locking surface 38 near the top of slot 40 in FIG. 4 in the prior embodiment.

Figure 5:
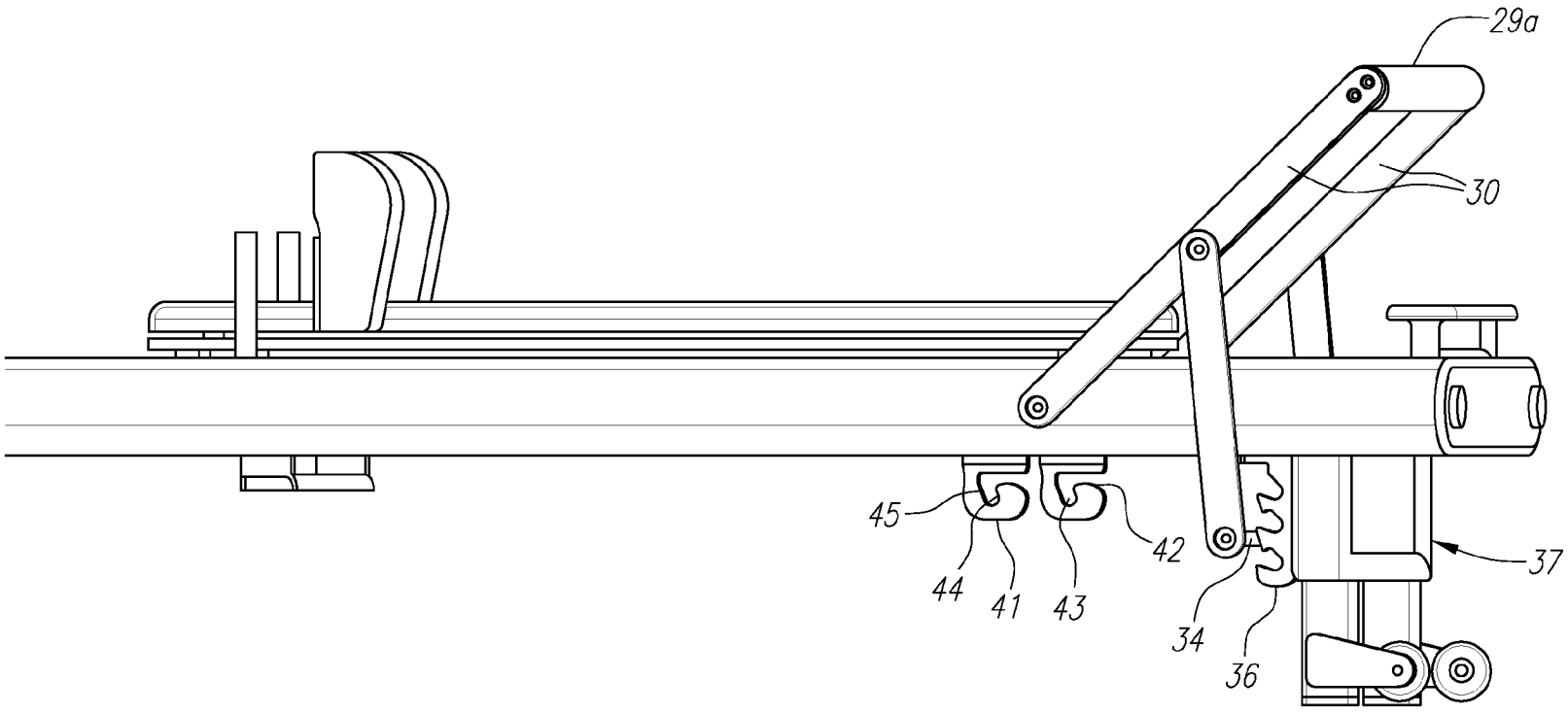
FIG. 5 is a side view of an exercise table showing components of an adjustable foot bar assembly.

Another aspect of the invention involves the storage of foot bar assembly 29, which is now described with reference to FIGS. 2 and 5. As described in more detail later, such storage facilitates storage of the overall reformer 1 in a stack of similarly configured reformers. It also helps the reformer to be lifted to be moved. The storage aspect described below also generally allows foot bar assembly 29, and foot bar 29*a*, to be lowered if that is otherwise desired. For this aspect of the current invention, reformer 1 may include a pair of storage brackets 41 to receive engagement bar 34.

Brackets 41 may be mounted to the underneath of the left and right side frame members 11, 12. Each storage bracket 41 may include a horizontal slot 42 with an opening sized to accept engagement bar 34. Links 33 may pass to the outside of brackets 41 so that bar 34 may extend into horizontal slot 42. Horizontal slot 42 is preferably contiguous with a substantially vertical slot 43 that extends downward. To store foot bar assembly 29, engagement bar 34 is first released from the pair of positioning slots 40 as described above. Foot bar 29*a* is then lifted and support bar assembly 32 positioned such that engagement bar 34 may first enter horizontal slots 42, and may then be dropped into vertical slot 43 to a storage position. Engagement bar 34 may then generally be held in place by the sides of vertical slot 43, i.e., foot end wall 44 and head end wall 45.

When in this storage position, foot bar parallel side links 30 may be substantially parallel to the ground and are preferably within the vertical profile of sides 11, 12 of frame 10. Also when in this storage position, foot bar 29*a* is preferably located beyond the foot end 14 of frame 10 and also positioned within the vertical profile of frame 10.

The vertical slots 43 in storage brackets 41 are preferably sized and positioned to allow the user to use foot bar 29*a* as a lift handle when lifting reformer 1 for stacking or relocation purposes. To this end, when the user lifts foot bar 29*a*, engagement bar 34 is pulled forward against the foot end wall 44 of vertical slot 43. As shown, the top of foot end wall 44 is curved towards head end 13 so as to help secure bar 34. The direction of force is such that engagement bar 34 is pulled into the vertical wall 44 and secured by its curved top section rather than being pulled upward releasing it from slots 43, 42 of storage brackets 41. This allows rod 29*a* to be used as a lifting handle for the foot end 14 of reformer 1.

In order to remove the foot bar assembly 29 from this storage position, side bars 33 of support bar assembly 32 may be lifted, i.e., rotated about the pivot points connecting bars 33 to side bars 30. While side bars 33 are so moved, it is preferred that the rest of foot bar assembly 29 is not moved which allows engagement rod 34 (attached at or near the ends of side bars 33) to move in an arcuate path about those pivot points. In this manner, rod 34 generally moves up and to the left from the bottom of vertical slot 43.

To avoid jamming of engagement bar 34 with brackets 45, however, it is preferred that the head end wall 45 of vertical slot 43 has a shape that is the same as or similar to the arcuate path followed by rod 34. To this end, head end wall 45 may be curvilinearly directed up and towards the head end 13. With the head end wall 45 being shaped in this manner, as engagement bar 34 follows its arcuate path, it preferably moves in a path that is coincident to the curve of the head end wall 45, so that bar 34 stays centered in the slot. Engagement bar 34 may then be removed from horizontal slot 42 and foot bar assembly 29 may be set to one of the positions in brackets 35, 36.

Figure 6:
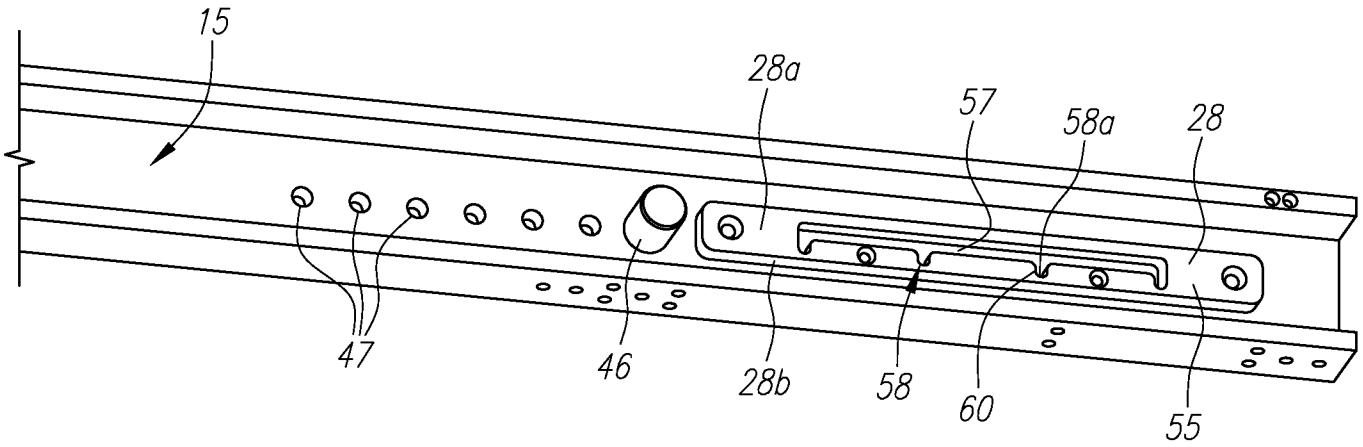
FIG. 6 is detailed view of a components associated with adjustment of the starting position of the carriage and adjustment of the anchor bar assembly.

An aspect of the current invention relating to adjustment of the starting position of the carriage or platform 16 relative to foot bar 29*a* is now further described with reference to FIGS. 2, 6 and 7. As noted earlier, reformer 1 will be used by people of different heights and having different leg lengths. Varying the start position of platform 16 relative to foot bar 29*a* helps accommodate users of various anthropomorphic measurements as well as various exercise patterns. For example, it may be desired to adjust the starting position of platform 16 further away from foot bar 29*a* for users having longer legs, so that when in the starting position, the user's legs will not be unduly folded. As another example, it may be desired to adjust the starting position of platform 16 to be closer to foot bar 29*a* for shorter-legged users so that they may perform exercises with a full range of motion.

To vary the start position of platform 16, reformer 1 preferably includes a position block 46 located in the inwardly facing channel 15 side 12. Only one position block 46 is generally necessary for this aspect of the invention, and block 46 may alternately be located on side 11. Generally, block 46 limits the movement of platform 16 by stopping vertical roller 17 from advancing closer to the foot end 14.

Before beginning an exercise, positioning block 46 is preferably placed in any one of holes 47 located in the right side frame member 12. Though four holes 47 are shown (with one of the holes receiving block 46), another number of holes 47 may be used. In general, block 46 may be placed in a hole 47 closer to the foot end 14 of reformer 1 for shorter users or for certain exercises. Similarly, block 46 may be placed in a hole farther away from the foot end 14 for taller users and other types of exercises.

Figure 7:
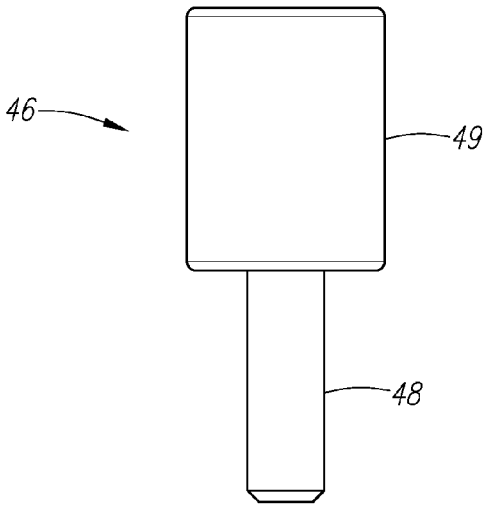
FIG. 7 is a side view of an adjustment block.

As shown in FIG. 7, positioning block 46 may include engagement pin 48 overmolded with a cylinder 49 of rubber or similar like material. Other methods may be used to manufacture pin 48 and cylinder 49. Engagement pin 48 is preferably sized so as to snugly fit within any of the holes 47.

In a preferred embodiment, side rails 11, 12 may comprise extruded aluminum members that are contiguous with their respective inward channels 15. In this embodiment, each side rail member 11, 12 may be hollow inside, and it is preferred that a wood block (not shown) with a commensurate hole pattern be assembled inside this cavity (not shown) so that the hole patterns of the wood block and channel 15 match up to receive pin 48 of block 46. The wood block in the side member cavity provides additional support for the engagement pin 48 by providing a deeper hole to receive such pin 48 (as opposed to only being received by a hole 47 having a thickness equal to the aluminum extruded wall. This insures that block 46 is not dislodged when contacted by the front right wheel 17 of the support platform. 16, as shown in FIG. 2.

An aspect of the current invention relating to adjusting the starting tension of springs 24 or other resistance mechanism is now further described with reference to FIGS. 2, 3, 6 and 8. When moving the starting position of platform 16 by adjusting block 46, the starting tension of springs 24 may vary. For example, if the starting platform position is moved to the position closest to foot end 14, springs 24 may have slack or very little tension. And springs 24 may experience more tension only after platform 16 is moved away from the foot end 14 by the user. However, if the starting position of platform 16 is located farther from foot end 14, springs 24 may have tension before the user pushes platform 16 away from the foot end.

In order to adjust the starting tension of resistance elements 24 so that the starting tension is the same or similar regardless of the start position of support platform 16, the position of anchor bar assembly 27 may be adjusted commensurate with the start position of support platform 16. This preferably results in a consistent distance between anchor bar 27 and support platform 16. And if the starting position of platform 16 is moved again, the position of anchor bar assembly 27 may be moved a commensurate amount. Furthermore, if for some reason it is desired to adjust the starting tension of springs 24 for a given platform 16 starting position, anchor bar 27 may be adjusted regardless of the starting position of platform 16 to provide more or less starting tension if desired for a particular exercise.

Anchor bar assembly 27 may generally engage positioning plates 28 that are preferably mounted in the inward facing channels 15 of side members 11, 12 of frame 10. Generally, plates 28 preferably provide one or more functional locations at which anchor bar assembly 27 may be mounted to frame 10. The interaction between anchor bar assembly 27 and plates 28 is discussed in more detail below.

Anchor bar assembly 27 may include bar 50 with eyebolts 51 attached thereto. Eyebolts 51 are preferably spaced to correspond to the spacing between springs 24 as they are attached to platform 16. In a preferred embodiment, one or more resistance elements 24 may be selectively attached to eyebolts 51 at their second ends 26. Reformer 1 preferably includes springs 24 having different resistances so that they may be attached to eyebolts 51 in different combinations to provide different overall resistances. Which springs are attached to eyebolts 51 may depend on the user and the desired exercise pattern.

As noted above anchor bar assembly 27 may include positioning devices or brackets 61 that may be attached to the ends of bar 50 and that may include outwardly facing U-channels 52. U-Channels 52 may include top and bottom flanges 52*a*, 52*b* that may be horizontal and that may be connected by vertical wall 52*c*. U-channels 52 are preferably configured so that they generally surround anchor bar positioning plates 28. More specifically, the distance between the top and bottom flanges 52*a*, 52*b* is generally larger than the vertical dimension of plates 28. However, as discussed below, the distance between flanges 52*a*, 52*b* is preferably not significantly larger than the vertical dimension of plates 28 to prevent or limit rotation of bar 50, which might otherwise occur when, e.g., no springs are attached to eyebolts 51. The relative dimensions of brackets 61 in relation to plates 28 also allow efficient adjustment of anchor bar assembly 27 in relation to plates 28, in that excessive play therebetween may be avoided.

Anchor bar assembly 27 preferably includes rollers 53 that are rotatably mounted on axles 54 that extend between top and bottom flanges 52*a*, 52*b*. Rollers 53 are preferably sized so that their diameter fits within the u-channel 52. Rollers 53 are also preferably positioned so that they are in close proximity to the face 55 of the positioning plate 28. In this manner, rollers 53 may rotate against positioning plates 28 when anchor bar assembly 27 is adjusted as discussed below. Anchor bar assembly 27 also preferably includes positioning pins 56 that extend from each end of bar 50 and into u-channel 52.

Anchor bar positioning plates 28 are preferably mounted to each side frame member 11, 12 and include horizontal slot 57 and one or more vertical slots 58. Plates 28 are preferably mounted at the same relative location on each of side members 11, 12 so that horizontal and vertical slots 57, 58 correspond. Positioning pins 56 are sized to snugly fit within the horizontal and vertical slots 57, 58. When pins 56 are located in corresponding vertical slots 58, anchor bar assembly 27 is located at a functional position (or mounting location). Pins 56 may travel through horizontal slot 57 to adjust to another functional location associated with another pair of corresponding vertical slots 57.

The interaction between anchor bar assembly 27 and positioning plates 28 is now further described. Anchor bar assembly 27 may reside in one or more different functional positions, i.e., when it has been adjusted to the desired position and is thus functional for an exercise to begin. When in a functional position, positioning pins 56 rest at the bottom 58*a* of corresponding vertical slots 58 on either side of frame 10, and the lower surface 59 of corresponding top flanges 52*a* rest on or are otherwise in close proximity to the upper edge or top surface 28*a* of positioning plates 28.

With this configuration, the upper wall 59 of top flanges 52*a* prevent or limit any rotation of anchor bar assembly 27 when the resistance elements 24 are removed. The weight of anchor bar assembly 27 may also help prevent or limit any such rotation. This is in contrast to prior anchor bar designs that are essentially a rod placed into slots on either side of the frame, and which are free to rotate when the springs are removed. (The rotation typically occurs because the weight of the eyebolts or other devices used to attach the springs to the rod causes the rod to rotate so that the eyebolts are facing downward.)

The prevention or limiting of rotation provided by the current invention is advantageous because even when all springs 24 are disconnected from rod 50, eyebolts 51 remain in a generally horizontal position making it much easier and efficient to reconnect one or more springs 24 to eyebolts 51. This can typically be done with only one hand. This is in contrast to the situation with prior anchor bars where the rod must first be rotated so that the eyebolts are in a position to receive the springs. This operation is more time consuming and takes two hands. The efficiency provided by the anchor bar assembly 27 of the current invention facilitates quickly adjusting reformer 1 to accommodate different exercises or different users.

The anchor bar assembly 27 of the current invention also provides a secure engagement between assembly 27 and frame 10 when an exercise is performed. During exercise, the second end 26 of one or more of the resistance elements 24 is selectively attached to a respective eye bolt 51 on anchor bar 50. Platform 16 is moved toward the head end 13 of reformer 1, for example, as the user presses against foot bar 29*a*. As this occurs, resistance elements 24 are stretched and the tension caused thereby also serves to pull anchor bar assembly 27 towards the head end 13 of reformer 1. This in turn causes positioning pins 56 to firmly engage the wall 60 of vertical slots 58.

To adjust the position of anchor bar assembly 27, all of the second ends 26 of resistance elements 24 are preferably removed from their respective eyebolts 51. Bar 50 may then be lifted until the upper surface of the bottom flange 52*b* of u-Channel 52 contacts the bottom edge 28*b* of positioning plate 28 and the positioning pins 56 of bar 50 are withdrawn from a respective pair of vertical slots 58. At this point, pins 56 are aligned with horizontal slot 57 and anchor bar assembly 27 may then be horizontally moved toward the foot end 14 or head end 13 until the positioning pins are aligned with the new desired vertical slots 58 and dropped into place.

Rollers 53 located in each u-channel 52 facilitate the smooth adjustment of anchor bar assembly 27. When anchor bar 27 is being adjusted, if the user (or instructor) applies unequal force causing bar 50 to angle, rollers 53 preferably contact the face 55 of positioning plate 28 to prevent u-channel assemblies 61 from jamming in place.

Another advantage of the anchor bar assembly 27 of the current invention is that it need not be completely removed from reformer 1 to effect adjustment. In fact, it is preferred that anchor bar assembly 27 generally remains attached to reformer 1 which avoids the risk of losing the anchor bar. This is accomplished by the engagement of the u-shaped brackets 61 with plates 28, as well as horizontal slot 57 having closed ends which may prevent assembly 27 from being removed. This is an advance over prior designs where the anchor bar is a simple rod or other device that must be completely removed from the reformer and then reinserted into another mounting location. In those prior designs, the anchor bar is a completely removable component that may be lost or damaged.

An alternate anchor bar assembly 100 and corresponding positioning plate 103 are now described with reference to FIGS. 10-12. As shown, spring anchor bar assembly 100 may include anchor bar 101 which may be similar to anchor bar 50 in the previous embodiment. Eyebolts or other devices (not shown) to engage springs 24 may be attached to bar 101. These devices may be similar to eyebolts 51 of the previous embodiment.

Figure 10:
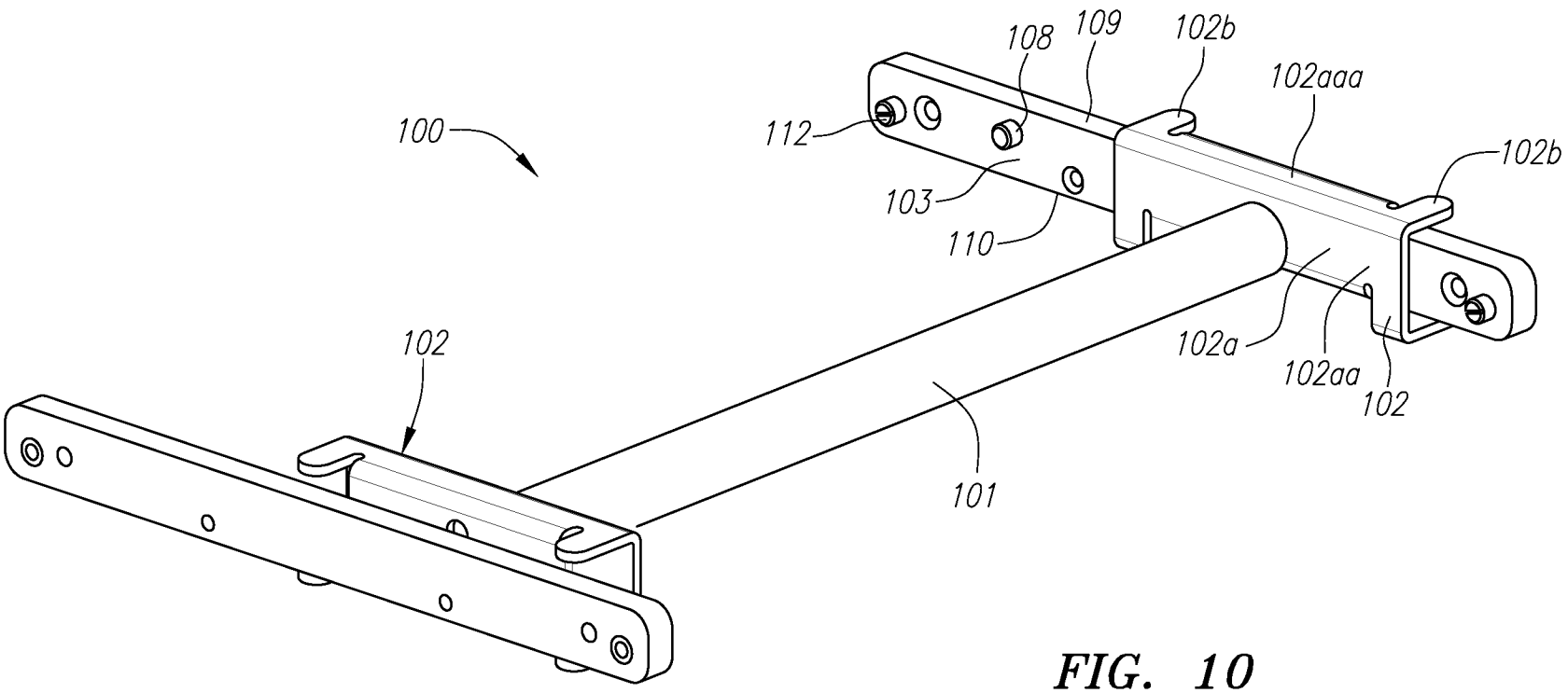
FIG. 10 is a perspective view of an alternate embodiment of an anchor bar assembly.

Brackets 102 may be attached to either end of anchor bar 101 as shown in FIG. 10. The attachment may be by welding or other mechanical attachment. A more detailed view of bracket 102 is shown in FIG. 11. Brackets 102 may include a central portion 102*a* and u-shaped flanges 102*b* at its ends. Brackets 102 may also include an outer wall 102*aa* that may contiguously run from central portion 102*a* to and through end flange portions 102*b*. Each flange 102*b* preferably includes upper flange 104 and lower flange 105. Central portion 102*a* may include downward flange 106 and horizontal flange 106*a*. Downward flange 106 may be connected to wall 102*aa* by a section 102*aaa*. The distance between wall 102*aa* and downward flange 106 may be defined by the length of section 102*aaa*, and may be the substantially the same as the length of flange 106*a*. In this manner, the outward face of flange 106 and the edge of flange 106*a* may generally reside in the same plane, and the lower edge of downward flange 106 and the end of flange 106*a* are generally aligned, with the space between them forming slot 111.

Brackets 102 may comprise a contiguous piece of sheet metal that undergoes several bending operations to result in the bracket 102 shown in the figures. Alternatively, bracket 102 may comprise several components fastened together.

As discussed more fully later, brackets 102 preferably engage positioning plates 103 which are mounted on side members 11, 12 of reformer 1. Positioning plates 103 may be mounted to side members 11, 12 by fastening screws 112 or by other suitable means. Plates 103 include an upper edge or surface 109, a bottom edge or surface 110, an inward face 103*a* and one or more pins 108.

Figure 11:
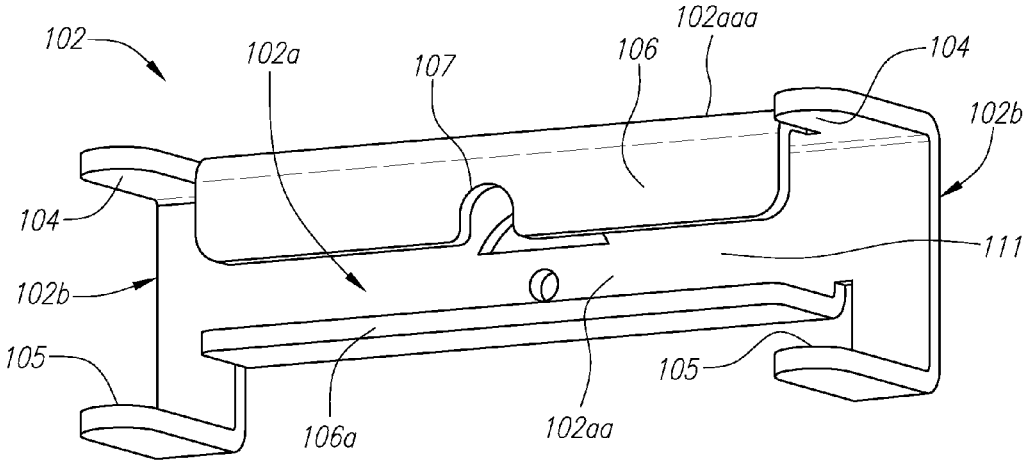
FIG. 11 is a perspective view of a bracket for an anchor bar assembly.
Figure 12:
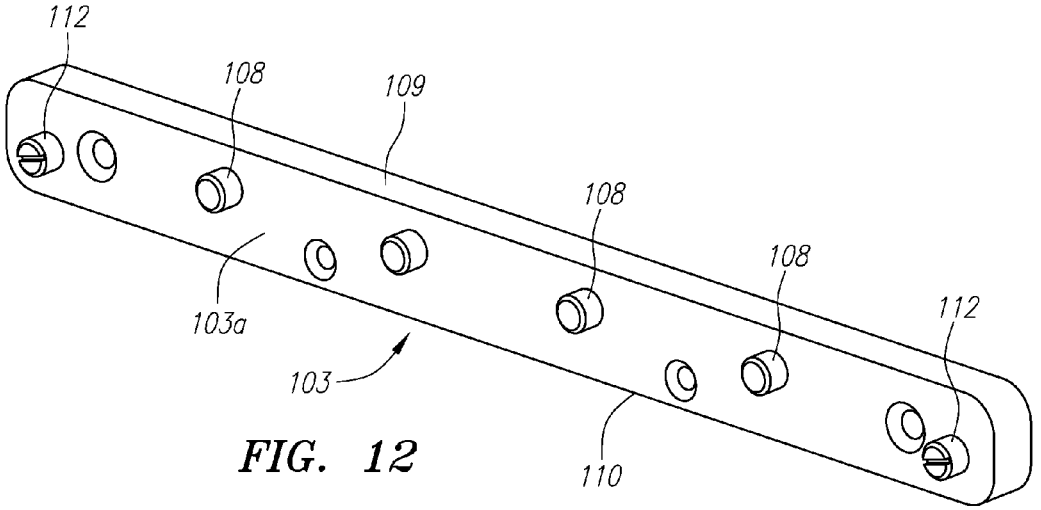
FIG. 12 is a perspective view of a positioning plate for an anchor bar assembly.

The inside surfaces of flanges 104 and 105 shown in FIG. 11, i.e., the lower surface of flange 104 and upper surface of flange 105, generally engage or surround the anchor bar positioning plate 103. More particularly, flanges 104 engage or are located above the upper surface 109 of plate 103, and flanges 105 engage or are located below the lower surface 110 of plate 103.

The flanges 106 and 106*a*, and more particularly, the outward face of flange 106 and the outward face or edge of flange 106*a*, or in close proximity to the face 103*a* of each positioning plate 103 mounted to the left and right frame members 11, 12. The engagement between flanges 106, 106*a* and their respective plate faces 103*a* prevents or limits anchor bar assembly 100 from racking or otherwise becoming angled in relation to side frame members 11, 12 when assembly 100 is moved along the length of reformer 1 to adjust the starting spring tension. This engagement preferably enables the anchor bar assembly 100 to be adjusted between positions more smoothly and avoids binding.

Flange 106 preferably includes slot 107 which may engage any of the one or more pins 108 attached to positioning plate 103. When anchor bar assembly 100 is in a functional position, the top of slot 107 bottoms against or otherwise engages a pin 108 in positioning plate 103. Also when in the functional position, the two flanges 104 are in close proximity to the top edge 109 of the positioning plate. If anchor bar assembly 100 rotates even slightly when in a functional position, one or the other or both of flanges 104 will contact the top edge 109 of positioning plate 103 and prohibit further rotation.

To adjust anchor bar assembly 100, resistance elements 24 are preferably detached. Anchor bar 101 may then be lifted up so that slot 107 disengages pin 108. When so lifted, bottom flanges 105 preferably contact bottom edge 110 of positioning plate 103 thereby limiting the height of the lift, which also serves to align pins 108 with horizontal slot 111 between flanges 106 and 106*a*. Accordingly, it is desired that the distance between flanges 104 and 105 be configured to provide this alignment. Anchor bar assembly 100 may then be moved to the head or foot end of reformer 1, with the positioning pins passing through slot 111 as indicated. Anchor bar assembly 100 may then be moved to the desired location and dropped down over the desired pin 108. At this time, pin 108 again engages slot 107 and anchor bar assembly 100 is in a functional position.

Positioning plates 103 may also include stop pins 112 to ensure that anchor bar assembly 100 is not accidently slid past the edge of the positioning plate. This again provides the benefit over prior designs involving anchor bars that are completely removed from the reformer as discussed above.

Figure 13:
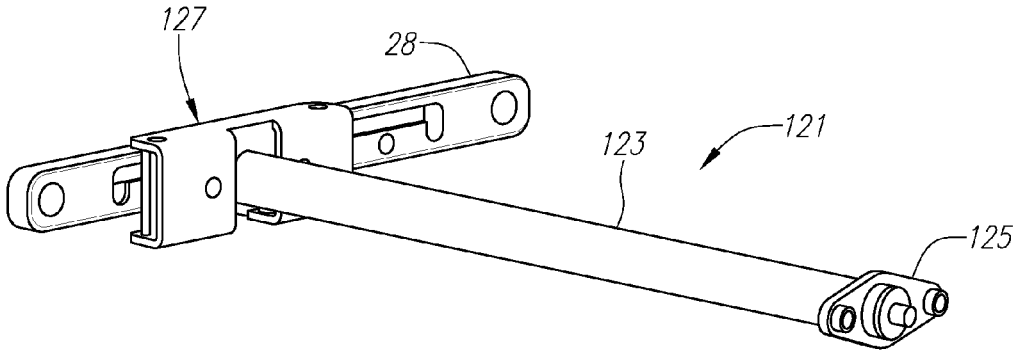
FIG. 13 is a perspective view of an alternate embodiment of an anchor bar assembly.
Figure 14:
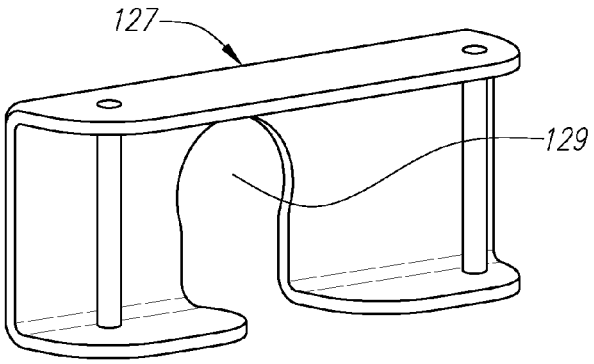
FIG. 14 is a perspective view of an end bracket.

Referring now to FIGS. 13-14, an alternate embodiment 121 for anchor bar assembly 27 is now described. Assembly 121 may be similar to the embodiment described in connection with FIGS. 6 and 8 in that it includes rod 123 with eyebolts attached thereto. Furthermore, the ends of rod 123 may be fitted with brackets 127 which may generally comprise the same u-shape as discussed above. But as shown in FIGS. 13-14, the ends of rod 123 may be fitted with flanges 125 at each end. These flanges may be welded to the ends of rod 123 and brackets 127 attached thereto by any suitable mechanical means. Once assembled, anchor bar assembly 121 functions similar to the other embodiments in that they are generally not removed from reformer 1 and prevent or limit rotation of bar 123. Brackets 127 may also include rollers similar to those discussed above.

An advantage of this embodiment relates to the assembly of the overall reformer 1. That is, the rod 123 along with attached flanges 125 may be positioned between the positioning plates 28. Then brackets 127 may be slipped onto flanges 125 by virtue of the slot 129 in each bracket 127, and may then be assembled. This preferably eases overall assembly.

Figure 9:
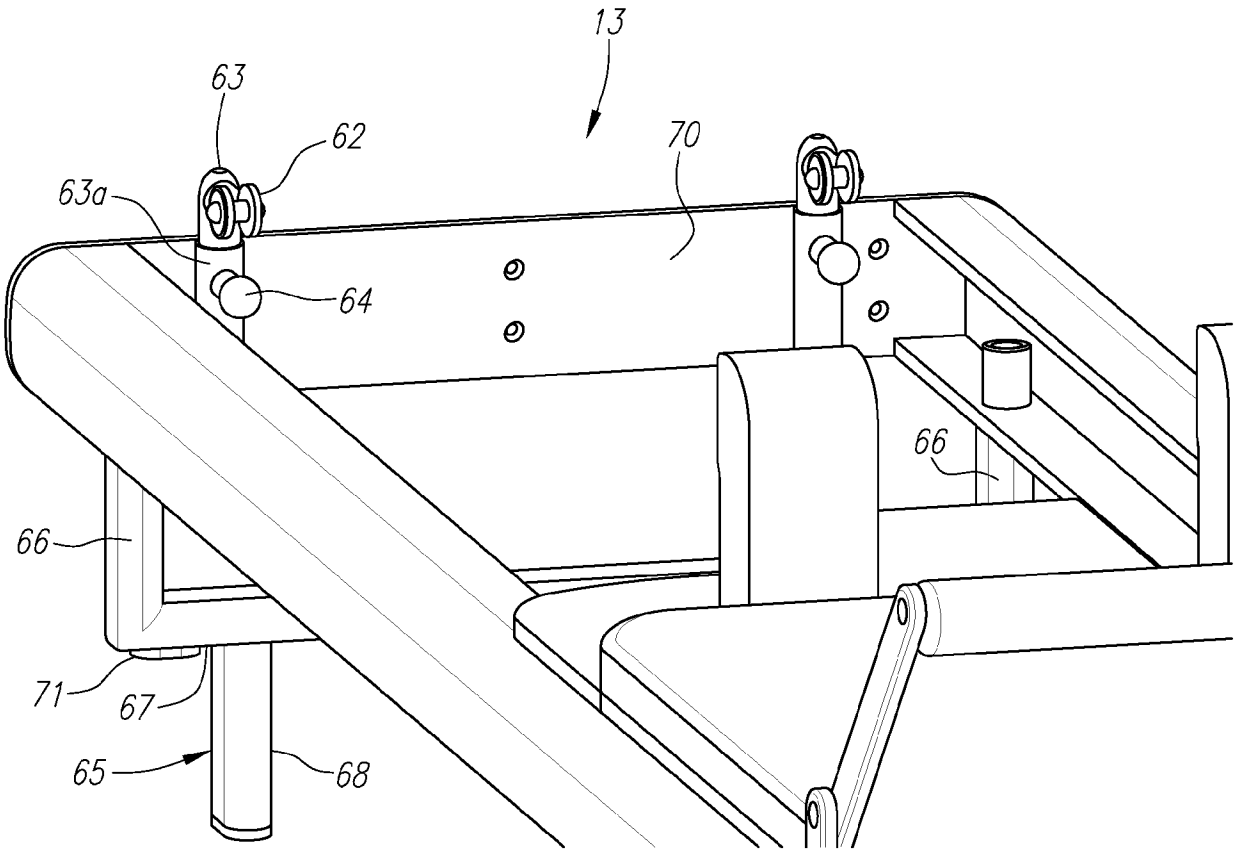
FIG. 9 is a perspective view showing a head end of a reformer including pulley assemblies.

Referring now to FIGS. 1 and 9, additional aspects of the current invention are now described. At or near head frame member 13, a pair of vertically adjustable pulleys 62 may be mounted to redirect the path of flexible ropes (not shown). Pulleys 62 may be mounted on vertical posts 63 that preferably move between an elevated functional position, and a retracted storage position as shown in FIG. 9. To this end, posts 63 may slide up and down within housing 63*a*. Posts 63 may include several holes which correspond to the raised functional position and lowered storage position. Pulleys 62 may be locked in their elevated functional position with lock pins 64 extending into a hole located relatively low on post 63. Posts 63 may also be restrained in their storage by gravity and friction, or by lock pin 64 engaging another hole located higher up on post 63.

Referring to FIGS. 1, 2, 4, 5 and 9, additional aspects of reformer 1 are now described. Reformer 1 may generally be supported by head support leg assembly 65 and foot support leg assembly 37 which are secured to the head and foot ends, respectively, and which may extend downwardly from the side frame members 11, 12. Each leg assembly 65, 37 may include a pair of vertical upper elements 66, horizontal element 67, and two vertical lower leg elements 68. The positioning plates 35, 36 for the foot bar support bar 32 or engagement bar 34 may be attached to the vertical upper elements 66 of the foot support leg assembly 37 as noted above. Rollers 69 may also be attached to lower leg elements 68 on the foot end assembly 37 for transporting the table. The exercise table 1 may be easily rolled between desired locations by lifting the head end 13 of table 1 and rolling it along the ground to a desired final location.

Another aspect of the current invention relating to storage and stacking of multiple reformers 1 is now described. Generally, because various components of exercise table 1 are movable between functional and storage positions, and because vertical lower leg elements 68 are configured in a certain manner, multiple reformers 1 may be stacked one on top the other. This is a significant advantage where reformers 1 will be used in a small pilates studio where space is at a premium.

More specifically, the vertical lower elements 68 are configured to fit within the open area 3 between side frame members 11, 12 by locating the legs 68 of each of the head and foot assemblies 65, 37 at a distance which is less than the distance between side frame members 11, 12. This allows legs 68 to pass through and between side frame members 11, 12. Furthermore, both foot bar assembly 29*a* and pulley assemblies 65 may be placed in their storage positions.

When stacking reformers 1, the reformer to be placed on top of another reformer may first be lifted by foot bar 29*a* at the foot end 14 and by head end plate 70 (as shown in FIG. 9) at the head end 13. Because foot bar assembly 29 is preferably secured when in the storage position as discussed above, foot bar 29*a* may serve as a lifting handle. The upper reformer may then be placed over the lower reformer by locating support legs 68 of the upper reformer so that they are aligned with the support leg assemblies 37, 65 of the lower reformer, and the upper reformer may then be lowered until stacking bumpers 71 (as shown in FIG. 9) located on the underside of the horizontal portion of each leg come to rest on the top of the side frame components 11, 12 of the lower reformer.

To also help in the efficient stacking of reformers 1, the platforms 16 may be securely positioned so that they also do not interfere with the legs 68 of an upper reformer extending down into the open spaces 3 of the lower reformer. To this end, block 46 may be inserted into the hole 47 closest to head end 13, and anchor bar assembly 27 is positioned in the slot 58 that is closest to head end 13. At least one resistance member 24 may then be attached to rod 50 or 101. This serves to maintain an open space 3 between the foot end of the platform 16 and foot end 14 of frame 10 so that the legs 68 of the rear leg assembly 37 may protrude down into that open space 3.

The exercise table 1 of the current invention may also be vertically stored. To vertically store reformer 1, support platform 16 may first be placed in a preferred position by inserting positioning block 46 in the positioning hole 47 closest to foot frame member 14, and anchor bar 50 may be placed in the vertical positioning slot 58 in the anchor bar positioning plate 28 that is also closest to foot member 14. At least one resistance member 24 may then be attached to rod 50 or 101. The foot bar support bar assembly 32 may then be placed in the highest positioning slot 40 of positioning plates 35, 36.

The reformer 1 may then be then lifted from head component 13 until vertical storage bumpers 72 (as shown in FIG. 4) contact the flooring surface. Reformer 1 may then rest on the two transport wheels 69 and the two vertical storage bumpers 72. Because carriage 16 is located nearer the foot end 14 of the reformer, the overall center of gravity is lower which helps tilting reformer 1, and also makes it more secure in its vertical storage position. Preferably the center of gravity in the vertical storage position is located between the line connecting the contact points of the two transport wheels and the line connecting the contact point of the two storage bumpers 72.

Furthermore, when in this vertical storage position, the reformer 1 is preferably tilted slightly toward the person who had tilted it up towards vertical. This provides stability during the tilting phase as opposed to other reformers which ultimately tilt away from the person tilting it, i.e., it is problematic to tilt a reformer upward knowing that its weight will be beyond true vertical when reaching its storage position.

While various embodiments of an exercise table and aspects thereof have been presented in the foregoing disclosure, numerous modifications, alterations and alternate embodiments may be contemplated by those skilled in the art and may be utilized in accomplishing the various aspects of the present invention. Thus, it is to be clearly understood that this description is made only by way of example and not as a limitation on the scope of the invention.

What is claimed is:

1. A reformer having an adjustable anchor rod assembly, comprising:

a frame having a pair of parallel side members, each side member having an inward-facing surface;

a carriage slidably connected to the frame;

a plate respectively attached to and extending part of the length of each inward-facing surface, the plates positioned opposing one another and the plates having a top and a bottom;

an anchor rod assembly that includes an anchor rod having two ends extending between the opposing plates, and a bracket at each end connectable to the opposing plates at a plurality of positions therealong in a manner that engages the top and/or bottom of the respective plates and that limits or prevents rotation; and a plurality of springs each having first and second ends, the first ends of the springs being attached to the carriage, and the second ends of the springs being connectable to the anchor rod.

2. The reformer of claim 1, wherein the bracket at each end includes a top flange and a bottom flange that engage the top and/or bottom of the respective plates to limit or prevent rotation.

3. The reformer of claim 2, wherein each bracket further includes a channel between the top flange and the bottom flange.

4. The reformer of claim 2, wherein each bracket further includes a receptacle, and each plate further includes a plurality of bosses each configured to engage the corresponding receptacle.

5. The reformer of claim 1, wherein the anchor rod assembly further comprises a pin at each end, and each plate includes a plurality of receptacles each configured to receive the corresponding pin.

6. The reformer of claim 1, further comprising an adjustable carriage stop.

7. The reformer of claim 6, wherein the adjustable carriage stop comprises a pin and a plurality of holes configured to receive the pin provided in the frame.

8. The reformer of claim 1, further comprising an adjustable foot bar pivotally connected to the frame.

9. A reformer having an adjustable foot bar assembly, comprising:

a frame;

a carriage slidably connected to the frame;

an adjustable foot bar assembly comprising:

a foot bar having a left end and a right end;

a left side link having a first end and a second end, the first end of the left side link attached to the left end of the foot bar and the second end of the left side link pivotally attached to the frame;

a right side link having a first end and a second end, the first end of the right side link attached to the left end of the foot bar and the second end of the right side link pivotally attached to the frame;

an engagement bar connected to the left and right side links; and a left side plate and a right side plate that each extend downward from the frame and that each respectively include a plurality of positioning receptacles configured to receive the engagement bar;

wherein the position of the foot bar relative to the frame corresponds to a selected positioning receptacle of the plurality of positioning receptacles the engagement bar is received in.

10. The reformer of claim 9, further comprising one or more storage brackets attached to the frame and configured to receive the engagement bar, wherein when the engagement bar is received in the one or more storage brackets, the foot bar is positioned in a storage position.

11. The reformer of claim 10, wherein the storage position of the foot bar is beyond the end of the frame, and wherein the one or more storage brackets are configured to receive the engagement bar securely enough that the foot bar can be used as a handle for moving the reformer.

12. The reformer of claim 9, wherein the plurality of positioning receptacles comprise slots provided in one or more positioning plates attached to the frame.

13. The reformer of claim 9, further comprising a left side bar and a right side bar, the left side bar attached to the engagement bar and pivotally attached to the left side link, the right side bar attached to the engagement bar and pivotally attached to the right side link.

14. The reformer of claim 13, wherein the plurality of positioning receptacles comprise slots provided in one or more positioning plates attached to the frame.

15. The reformer of claim 13, further comprising one or more storage brackets attached to the frame and configured to receive the engagement bar, wherein when the engagement bar is received in the one or more storage brackets, the foot bar is positioned in a storage position.

16. A reformer having an adjustable foot bar assembly and an adjustable anchor rod assembly, comprising:

a frame having a pair of parallel side members, each side member having an inward-facing channel;

a carriage slidably connected to the frame;

an adjustable foot bar assembly pivotally attached to the frame and including a foot bar and an engagement bar;

a left side plate and a right side plate that each extend downward from the frame and that each respectively include a plurality of positioning receptacles attached to the frame and configured to receive the engagement bar, wherein the position of the foot bar relative to the frame corresponds to which of the plurality of positioning receptacles the engagement bar is received in;

a plate respectively provided in and extending part of the length of each inward-facing channel, the plates positioned opposing one another and the plates having a top and a bottom;

an anchor rod assembly that includes an anchor rod having two ends extending between the opposing plates, and a bracket at each end connectable to the opposing plates at a plurality of positions therealong in a manner that engages the top and/or bottom of the respective plates and that limits or prevents rotation; and a plurality of springs each having first and second ends, the first ends of the springs being attached to the carriage, and the second ends of the springs being connectable to the anchor rod.

17. The reformer of claim 16, further comprising an adjustable carriage stop.

18. The reformer of claim 17, wherein the adjustable carriage stop comprises a pin and a plurality of holes configured to receive the pin provided in the frame.

19. The reformer of claim 18, wherein the pin includes a stopping portion comprising rubber or a like material, and an insertable portion, and wherein each of the plurality of holes has an inner profile that matches the outer profile of the insertable portion.

20. The reformer of claim 18, wherein the positions of the plurality of holes correspond to the positions of the plurality of positioning receptacles.

* * * * *